US006321502B1

(12) United States Patent
Castaño

(10) Patent No.: US 6,321,502 B1
(45) Date of Patent: Nov. 27, 2001

(54) METHOD OF MAKING CONNECTOR HUB

(75) Inventor: Francisco Castaño, Houston, TX (US)

(73) Assignee: Geometrica, Inc., Houston, TX (US)

( * ) Notice: Subject to any disclaimer, the term of this patent is extended or adjusted under 35 U.S.C. 154(b) by 0 days.

(21) Appl. No.: 09/334,541

(22) Filed: Jun. 16, 1999

(51) Int. Cl.[7] ..... E04H 12/00

(52) U.S. Cl. ..... 52/653.2; 52/81.1; 52/81.3; 52/582.1; 52/649.2; 52/653.2; 52/656.9; 52/633; 52/655.1; 403/171-173; 403/221

(58) Field of Search ..... 52/81.1, 582.1, 52/649.2, 653.2, 656.9, 633, 655.1, 81.3; 403/171, 172, 173, 221

(56) References Cited

U.S. PATENT DOCUMENTS

| | | | | |
|---|---|---|---|---|
| 2,895,753 | | 7/1959 | Fentiman . | |
| 2,916,109 | | 12/1959 | Fentiman . | |
| 2,931,467 | | 4/1960 | Fentiman . | |
| 2,964,147 | | 12/1960 | Fentiman . | |
| 2,976,968 | | 3/1961 | Fentiman . | |
| 3,079,681 | * | 3/1963 | Fentiman | 29/525 |
| 3,081,601 | | 3/1963 | Fentiman . | |
| 3,152,819 | | 10/1964 | Fentiman . | |
| 3,275,351 | | 9/1966 | Fentiman . | |
| 3,309,121 | | 3/1967 | Fentiman . | |
| 4,260,331 | * | 4/1981 | Goodwin | 416/219 |
| 5,147,180 | * | 9/1992 | Johnson | 416/219 |
| 5,867,961 | | 2/1999 | Castano . | |
| 5,924,258 | * | 7/1999 | Castano | 52/653.1 |
| 5,964,546 | * | 10/1999 | Castano | 403/344 |
| 6,009,914 | * | 1/2000 | Castano | 138/172 |

* cited by examiner

*Primary Examiner*—Carl D. Friedman
*Assistant Examiner*—Christy M. Syres
(74) *Attorney, Agent, or Firm*—Haynes and Boone, L.L.P.

(57) ABSTRACT

A method of making a connector hub to mate with tubular frame members, for use in constructing a free span building. The method includes constructing multiple slots, each slot having an open end, a closed end, and a longitudinal axis; and for each slot; disposing a tooth on either side of the longitudinal axis; and making the area of the connector material in shear to the area of the tubular frame member in tension, as an approximate ratio of the unit strength of the material of the tubular frame member in tension to the unit strength of the material of the connector in shear.

5 Claims, 4 Drawing Sheets

METHOD OF MAKING CONNECTOR HUB

BACKGROUND

The disclosures herein relate generally to free span buildings, that is, buildings with no intermediate vertical supports, and more particularly to the connector hubs used in the space frame construction of such buildings.

In space frame construction, a generally cylindrical connector hub includes a plurality of outwardly directed slots extending along the peripheral surface of the connector hub. The slots have opposed ribbed surfaces. Tubular frame members are flattened and crimped at their opposed ends. The crimped ends include elongated flat surfaces extending outwardly, or away from each other. The crimped ends are ribbed in a pattern which can be mated into engagement with the ribs in the connector hub slots. In this manner, each end of a tubular frame member may be slidably inserted into a respective connector hub slot, and several tubular frame members may be connected at one end to a connector hub slot to form a spider, i.e., a connector hub having a plurality of tubes extending outwardly therefrom, each tube terminating at a free end.

The free end of each tube can be similarly connected to another connector hub. Thus, a framework of interconnected spiders formed of tubes and connector hubs can be joined to form a pre-assembled or modular section of a flat roof, a domed roof, a wall, etc., to be joined with other sections to eventually form a complete structure. The structure once completed is then covered with a selected cladding which is attached to the structural framework by means of an interfacing cladding support system.

The cladding may be fabric, corrugated metal sheets, glass, or other selected materials, and may include combinations of these materials for architectural design purposes.

It is important that each end of a tubular frame member be slidably inserted by hand into a respective connector hub slot, so that an entire building may be constructed without special equipment, and with unskilled labor. Prior art designs of connector hub slots do not account for the "flash" (a small fragment of metal) which the manufacturing process leaves at the flattened, crimped ends of the tubular frame members. Thus, often the persons assembling the space frame construction are unable to insert the end of a tubular frame member into a connector hub slot without using hammers and excessive force, or without first grinding off the extra fragment of metal at the ends of each tubular frame member.

Another problem with prior art designs is that load stresses cause the connector slot to open up and loose engagement of one or more teeth before the load reaches substantially the yield strength of the tube, resulting in non-ductile failure and reduced strength.

Another problem with prior art designs is that no account is made of differing material properties that may exist between the tubular member material and the connector material, again resulting in failure of one of these before the tube reaches substantially the yield strength of the tube, resulting in non-ductile failure and reduced strength.

What is needed is a connector hub slot that can accommodate the flash, and which will not release a tubular frame member before the load stresses reach at least 100% of the tubular frame member's load capacity as measured by its rated minimum yield strength times its area. Also, what is needed is an elongated tube end and connector slot combination that will produce ductile failure under tensile stresses.

SUMMARY

One embodiment, accordingly, provides a method of making a connector hub to mate with a frame member in a free span building. Multiple slots are provided in a connector hub. Each slot has an open end, a closed end and a longitudinal axis. A tooth is disposed on either side of the longitudinal axis. The area of the slot in shear is to the area of the frame in tension, as an approximate ratio of unit strength of the material of the frame member in tension to the unit strength of the material of the slot in shear.

Advantageously, the area of the connector material in shear is to the area of the elongated member in shear, as an approximate ratio of the unit strength of the material of the elongated member in shear to the unit strength of the material of the connector in shear. The area of the connector material in shear is computed at the more critical slip plane of initial plastic failure for the connector material. An indentation is provided at the tip of the slot to receive the flash at the tip of the tube without causing material interference when the end of the elongated member is slidably inserted into the connector slot. The angle between a bearing face of the tooth and the longitudinal axis is within the range of 65 to 90 degrees. The teeth are disposed on opposite sides of the longitudinal axis. A distance perpendicular to the longitudinal axis, and between the teeth, is at least seventy percent of the throat length at the open end of the slot.

BRIEF DESCRIPTION OF THE DRAWINGS FIGURES

DETAILED DESCRIPTION

Figure 1:
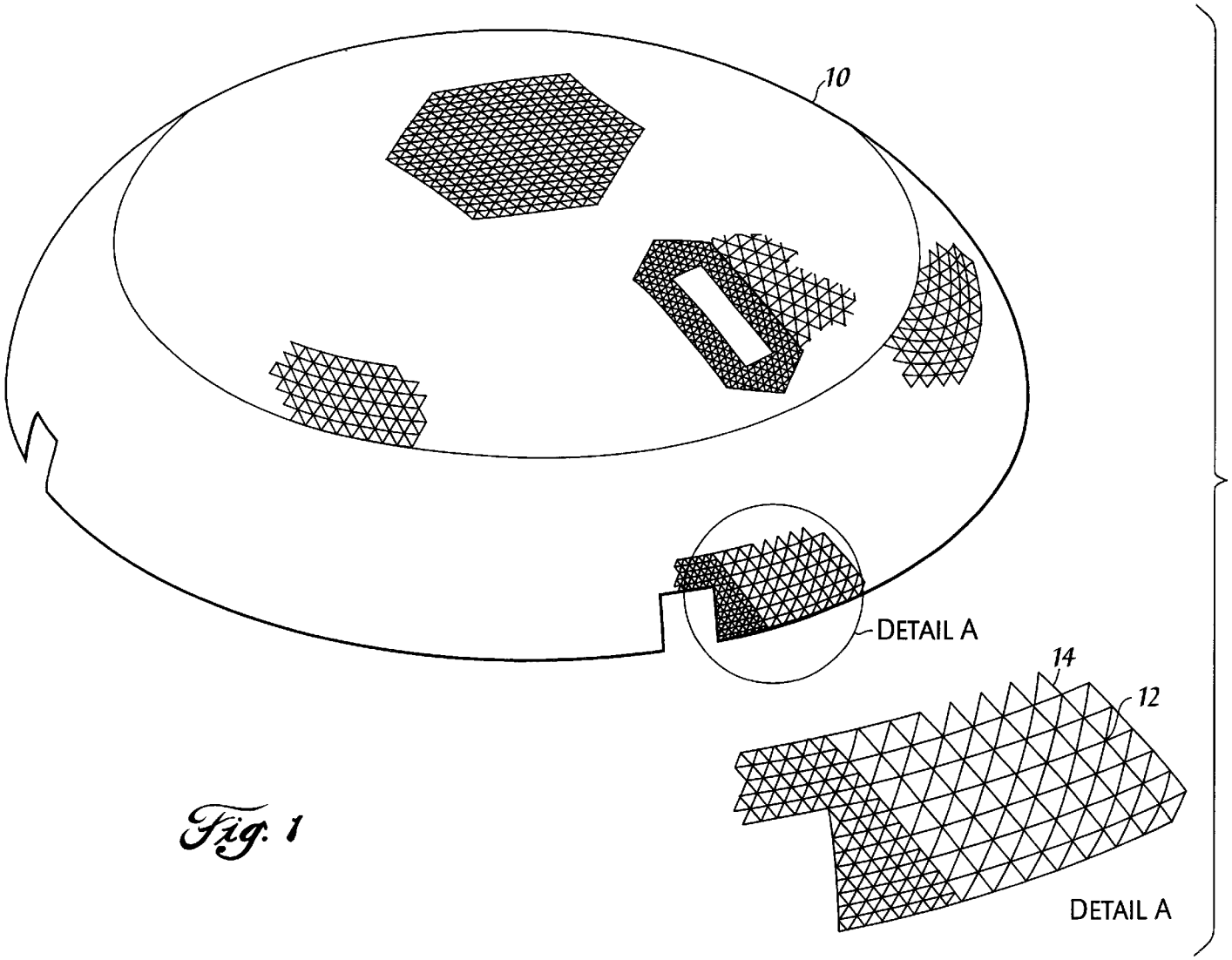
FIG. 1 is a view illustrating an embodiment of a clear span building using connector hubs and tubular frame members.

Referring now to FIG. 1, a clear span building 10 uses many connector hubs 12 connected to tubular frame members 14, to form the sides or the top, or roof, or both of a free-form building, having no intermediate vertical supports. The connector hubs 12 are made of AA 6000 series aluminum alloy or similar. The tubular frame members 14 are made of A500Grb or similar steel.

Figure 2:
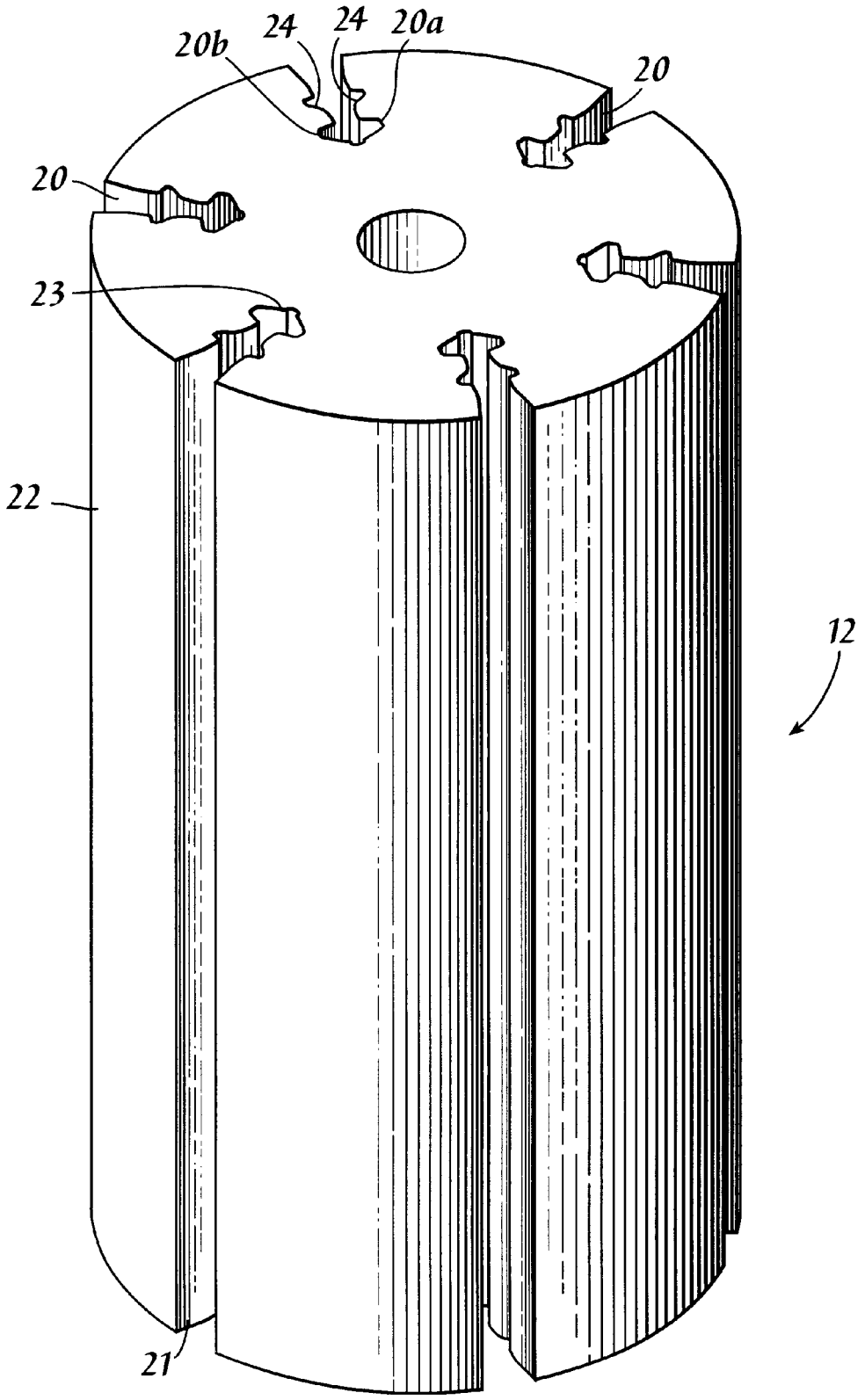
FIG. 2 is a isometric view illustrating an embodiment of a connector hub.

Referring now to FIG. 2, the connector hub 12 includes a plurality of slots 20 into which the ends of the tubular frame members insert. The slots 20 are formed to extend axially along a peripheral surface 22 of the connector hubs 12. The slots 20 are keyed with a plurality of slot teeth 24 on a pair of opposed slots sides 20*a* and 20*b* which face inwardly or toward each other. The connector hub 12 may be of a shape other than cylindrical. The slots 20 may also be outwardly directed without being radially directed. Each slot 20 includes an open end 21 and a closed end 23.

Figure 3:
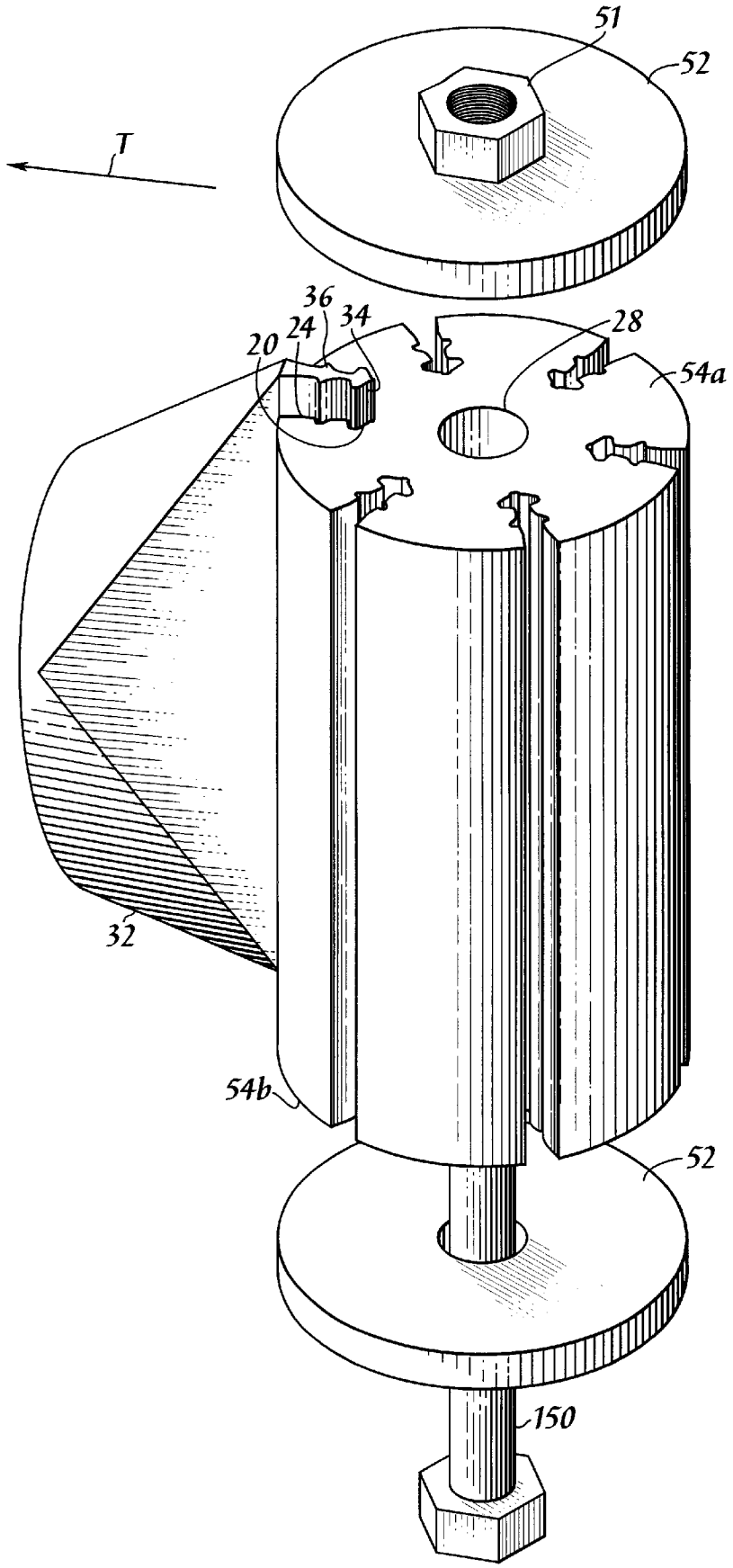
FIG. 3 is an isometric view illustrating an embodiment of a portion of a connector hub connected to a tubular support member.

Referring now to FIG. 3, a tubular support member 32 slides into each slot 20, and the slot 20 retains it in the following manner. Opposite ends 34 of the tubular support member 32 are flattened, and have several outwardly facing tube teeth 36 crimped into the ends 34, for mating engagement with the slot teeth 24. When the free span building 10 is complete, and in service, many of the forces on the tubular support members 32 are tension forces, trying to pull the ends 34 out of the slots 20, in the direction of the arrow designated T.

In order to retain tubular structural members 32 in the connector hub 12, a bolt 150, and a nut 51 are provided for extending through an axially extending bore 28. A pair of end plates or washers 52 are maintained in abutment with opposed ends 54*a*, 54*b* of the connector hub 12 by bolt 150 and nut 51. This captures the ends 34 within the slots 20.

Figure 4:
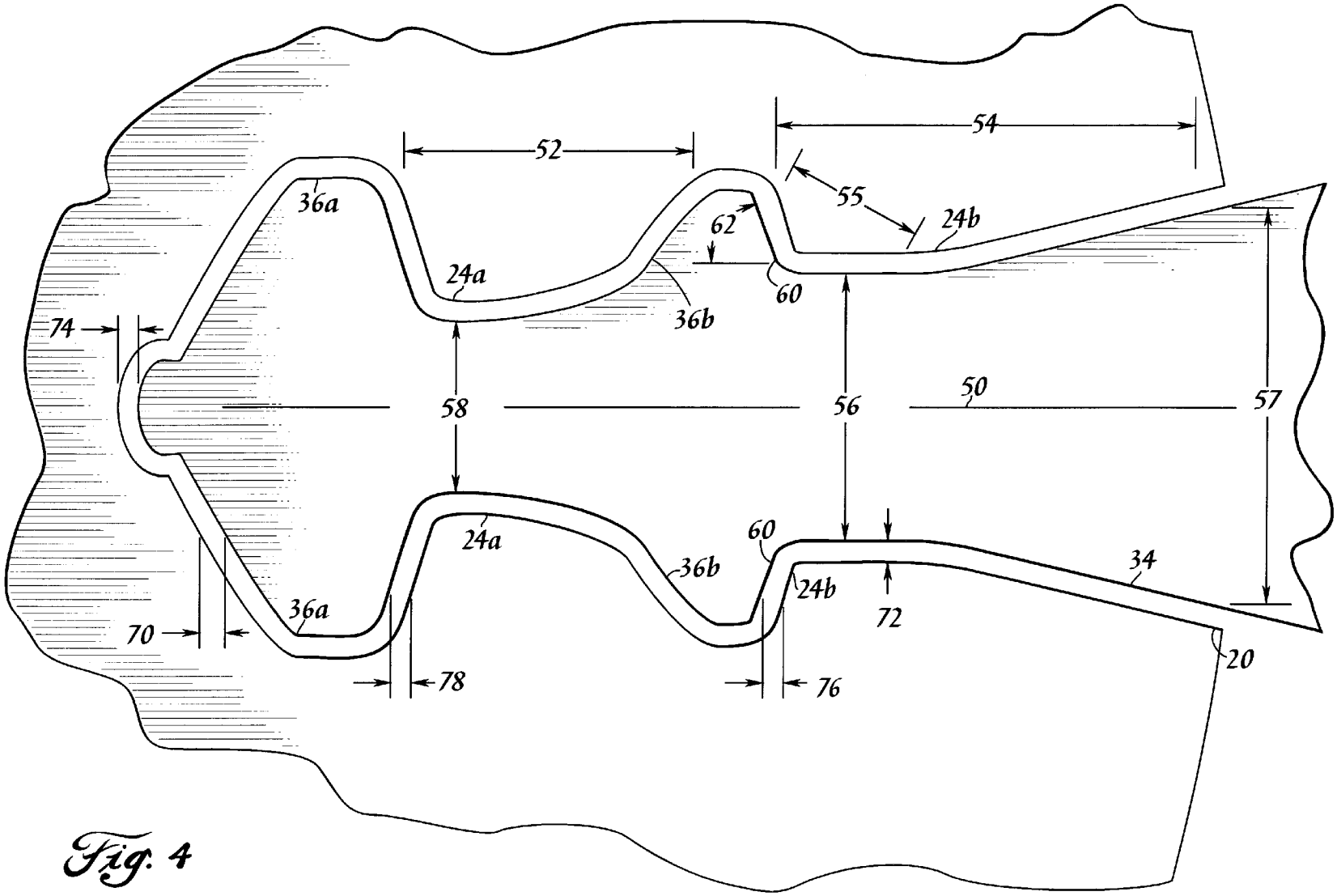
FIG. 4 is a partial plan view illustrating an embodiment of an end of a tubular support member inserted into a slot of a connector hub.

Referring now to FIG. 4, the slot 20 and the end 34 share a common longitudinal axis 50. The slot teeth 24*a* and 24*b*, and the tube teeth 36*a* and 36*b* are symmetrically or asymmetrically disposed on either side of the longitudinal axis 50. For either side of the longitudinal axis 50, the area of the slot 20 in shear would appear to be proportional to the sum of distances 52 and 54. However, the slot tooth 24*b* has an initial slip plane distance 55 that is actually the portion of the slot tooth 24*b* in shear. The initial slip plane distance 55 has a length that is approximately half the length of the distance 54.

The area of the end 34 in tension is proportional to a throat width 56. The throat width 56 is determined by making it at least seventy percent of a throat width 57 adjacent the end 21, which itself is twice the wall thickness of the tubular frame member 14. The seventy percent standard is used because the typical ratio of yielding strength of the steel, 42 ksi, divided by the ultimate strength of the steel, 60 ksi, is seventy percent. And though there is work-hardening in fabrication, keeping this ratio as minimum assures yield failure in gross section before ultimate failure in the reduced section of the elongated member, resulting in ductile behavior.

The yield strength of the steel in the region between the slot teeth 24*a* and 24*b* is increased by work-hardening, thus allowing a further reduction in that area, without a decrease in the strength of the steel.

The sum of the distances 52 and 55 is approximately 2.5 times larger than one-half of the throat width 56, which ratio is the approximate ratio of the strength of the steel of the tubular frame member 14 in tension to the strength of the aluminum of the connector hub 12 in shear. In an alternate embodiment, the slot 20 and the end 34 include only the slot teeth 24*a* and the tube teeth 36*a*. In the alternate embodiment, the distance 52 (proportional to the area of the aluminum in shear) is more than three times a one-half throat width 58.

$$\frac{A500Grb\ \text{steel}-\text{tension}-\text{strength}}{6061\ T6\ \text{aluminum}-\text{shear}-\text{strength}} = \frac{60}{24} = 2.5$$

The tube teeth 36*b* have a bearing face 60. The angle 62 between the bearing face 60 and the longitudinal axis 50 is approximately seventy-five degrees. The gap, or tolerance, between the slot 20 and the end 34 is greater in the length than the width. Thus, a length tolerance 70 is greater than a width tolerance 72. In addition to the length tolerance 70, the slot 20 also has, at its closed end, a tip indentation 74 to accommodate the flash which is left on the end 34 in the flattening process. Also, a tolerance 76 between the slot teeth 24*b* and the tube teeth 36*b* is less than a tolerance 78 between the slot teeth 24*a* and the tube teeth 36*a*. The purpose of this difference in tolerance is so that when the tubular frame member 14, and thus the end 34, is in tension, the slot teeth 24*b* and the tube teeth 36*b* engage before the slot teeth 24*a* and the tube teeth 36*a* engage. By so doing, the tension load is better spread through the end 34.

A method of making a connector hub includes the steps of: constructing multiple slots, forming an open end in the slot; forming a closed end in the slot; disposing a tooth on either side of the longitudinal axis of the slot; forming a throat length at the open end to be about twice the wall thickness of the tubular frame member; and making the area of the connector material in shear to the area of the tubular frame member in tension, as an approximate ratio of the unit strength of the material of the tubular frame member in tension to the unit strength of the material of the connector in shear.

Although illustrative embodiments have been described, a wide range of modification, change, and substitution is contemplated in the foregoing disclosure. In some instances, some features of the embodiments may be employed without a corresponding use of other features. Accordingly, it is appropriate that the appended claims be construed broadly, and in a manner consistent with the scope of the embodiments disclosed herein.

What is claimed is:

1. A method of making a connector hub to mate with tubular support members, for use in constructing a free span building, the method comprising:

constructing multiple slots in a connector hub, each slot having an open end, a closed end, and a longitudinal axis;

providing a first slot tooth and a second slot tooth on each opposite side of the longitudinal axis;

providing a tubular support member including a first and a second support tooth on each opposite side of an end of the support member for mating engagement with a respective slot tooth;

providing a first tooth tolerance between each first slot tooth and each first support tooth;

providing a second tooth tolerance between each second slot tooth and each second support tooth, the first tooth tolerance being less than the second tooth tolerance, whereby in tension, a first support tooth engages a first slot tooth prior to a second support tooth engaging a second slot tooth;

providing a first throat width on the tubular support member adjacent the first support tooth; and providing a second throat width on the tubular support member adjacent the open end, the first throat width being at least 75% of the second throat width.

2. The method of claim 1 further comprising:

making a length tolerance between the tubular support member and the slot greater than a width tolerance between the tubular support member and the slot.

3. The method of claim 1 further comprising:

forming a tip indentation in the slot.

4. A method of making a connector hub to mate with tubular support members, for use in constructing a free span building, the method comprising:

constructing multiple slots in a connector hub, each slot having an open end, a closed end, and a longitudinal axis;

providing a first and a second slot tooth on each opposite side of the longitudinal axis;

providing a tubular support member including a first and a second support tooth on each opposite side of an end of the support member for mating engagement with a respective slot tooth;

making a length tolerance between the tubular support member and the slot greater than a width tolerance between the tubular support member and the slot;

providing a first throat width on the tubular support member adjacent the first support tooth; and providing a second throat width on the tubular support member adjacent the open end, the first throat width being at least 75% of the second throat width.

5. A method of making a connector hub to mate with tubular support members, for use in constructing a free span building, the method comprising:

constructing multiple slots in a connector hub, each slot having an open end, a closed end, and a longitudinal axis;

providing a slot tooth on each opposite side of the longitudinal axis;

providing a tubular support member including a support tooth on each opposite side of an end of the support member for mating engagement with a respective slot tooth;

making a length tolerance between the tubular support member and the slot greater than a width tolerance between the tubular support member and the slot;

providing a first throat width on the tubular support member adjacent the support tooth; and providing a second throat width on the tubular support member adjacent the open end, the first throat width being at least 75% of the second throat width.

* * * * *